United States Patent [19]

Silvera

[11] Patent Number: 4,969,921

[45] Date of Patent: Nov. 13, 1990

[54] GOLF CLUB SWING TRAINING DEVICE

[76] Inventor: Richard Silvera, 2471 Century Hills, Los Angeles, Calif. 90067

[21] Appl. No.: 495,377

[22] Filed: Mar. 19, 1990

[51] Int. Cl.[5] ..... A63B 69/36

[52] U.S. Cl. ..... 273/186 A; 273/194 R; 273/193 A

[58] Field of Search ..... 273/186 R, 186 A, 186 C, 273/194 R, 194 B, 26 B, 29 A, 193 R, 193 A

[56] References Cited

U.S. PATENT DOCUMENTS

| | | | |
|---|---|---|---|
| 1,471,794 | 10/1923 | Leven | 273/193 X |
| 1,712,609 | 5/1929 | Gibson | 273/194 R |
| 2,223,647 | 12/1940 | Stumpf | 273/193 X |
| 2,986,937 | 6/1961 | Chapman | 273/194 X |
| 3,561,272 | 2/1971 | Davis | 273/194 |
| 3,733,077 | 5/1973 | Fennell | 273/186 A |
| 4,168,068 | 9/1979 | Grover | 273/186 A |
| 4,270,753 | 6/1981 | Maroth et al. | 273/186 A |
| 4,363,488 | 12/1982 | Maroth et al. | 273/186 A |
| 4,541,631 | 9/1985 | Sasse | 273/170 |
| 4,671,508 | 6/1987 | Tetreault | 273/26 B |
| 4,684,133 | 8/1987 | Maroth | 273/186 A |
| 4,809,975 | 3/1989 | Lee | 272/128 |

*Primary Examiner*—George J. Marlo

*Attorney, Agent, or Firm*—Poms, Smith, Lande and Rose

[57] ABSTRACT

A golf club swing training device is mounted to the shaft of a golf club to enable a user to improve muscle coordination and follow through during swinging of the golf club. The training device is in the form of a tube which is clamped in a parallel spaced apart relationship to the shaft. A weight is disposed within the tube in axially slidable engagement. A spring biases the weight towards the first or upper end of the tube when attached to the golf club. Upon the user swinging the golf club, centrifugal force urges the weight toward the second or lower end of the tube so that the user feels increased torque during the swing. The weight may further be fixed in a selected position within the tube by a retainer pin received through the tube and engaging the weight therein to provide a fixed weight during the swing.

13 Claims, 1 Drawing Sheet

GOLF CLUB SWING TRAINING DEVICE

FIELD OF THE INVENTION

The present invention relates generally to sporting goods, and more particularly to a training device used for improving the proficiency of the stroke and follow through of a golf club swing.

BACKGROUND OF THE INVENTION

Weighted sporting goods, such as baseball bats, tennis racquets and the like, have been used for many years during practice swinging of such sporting goods. After practicing with a weighted device, the actual device will feel lighter and quicker in the hands when used during actual play. For example, in baseball the batter waiting in the on-deck circle calmly swings a weighted bat or several bats together. The most common type of weight used in the on-deck circle is a doughnut-shaped weight which is slipped over the handle end of the bat and is restrained at its inner periphery by the widened portion of the bat.

A similar device has been developed for golfers. For example, in U.S. Pat. No. 4,809,975, a golf club swing trainer for developing arm muscles is disclosed. The swing trainer includes a truncated golf club shaft and a weight slidably mounted on the shaft. A golf club handle is formed at one end of the shaft. At the other end of the shaft, a coil spring is coaxially mounted over the shaft. The spring provides a resistance on the weight as the weight swings toward the end of the shaft when the trainer is swung like a golf club. The sensation of increased torque from the centrifugal force causing the weight to move down the shaft can then be felt in the arm of the person using the device. With the use of such a practice device, one can learn the feel of a correct golf club swing.

A disadvantage and limitation of the device disclosed in the '975 patent is that the user does not have an actual golf club with a golf club head that allows him to also visually determine a proper arc of the golf club. Furthermore, the known prior art does not disclose any type of sports training device which combines the effect of using a fixed weight, such as on a bat, with a slidable weight as disclosed in the '975 patent.

SUMMARY OF THE INVENTION

It is therefore an object of the present invention to overcome one or more of the disadvantages and limitations of the prior art enumerated above. It is a further object of the present invention to provide a golf club swing training device which may be used in conjunction with a golf club and is easily attached and removed therefrom. It is a further object of the present invention to provide a swing training device for a golf club which may either utilize a weight which varies the torque during the swing by a weight movable under centrifugal force or utilizes a weight at a fixed position on the golf club.

According to the present invention, the golf club swing training device includes an elongated track having a first end and a second end. A weight is held by the track in linear slidable engagement. A spring biases the weight at a first end of the track. The track is then attached in a parallel spaced-apart relationship to a shaft of a golf club. When the user swings the golf club, increased torque may be felt as the weight moves to the second end of the shaft under centrifugal force. Retainer pins may be received by the track and the weight so that a weight fixed at a predetermined position on the track may also be provided.

An advantage of the present invention is that a user obtains the feel and indication of full extension of a golf swing at proper club speed when the weight hits a strike plate at the second end of the shaft. The hitting of the strike plate simulates ball contact. The retainer pin may hold the weight at the second end after hitting the strike plate enabling the user to emphasize proper extension.

It is a feature of the present invention that three distinct methods of weight utilization are employed. First, the weight may be freely movable to move against spring force during extension and return under spring force during follow through. Secondly, the weight may be mOVable to move against spring force during extension and be locked during follow through until manually released. Finally, the weight may be locked in place during extension and follow through.

These and other objects, advantages and features of the present invention will become readily apparent to those skilled in the art from a study of the following description of the exemplary preferred embodiment when read in conjunction with the attached drawings and appended claims.

DESCRIPTION OF AN EXEMPLARY PREFERRED EMBODIMENT

Figure 1:
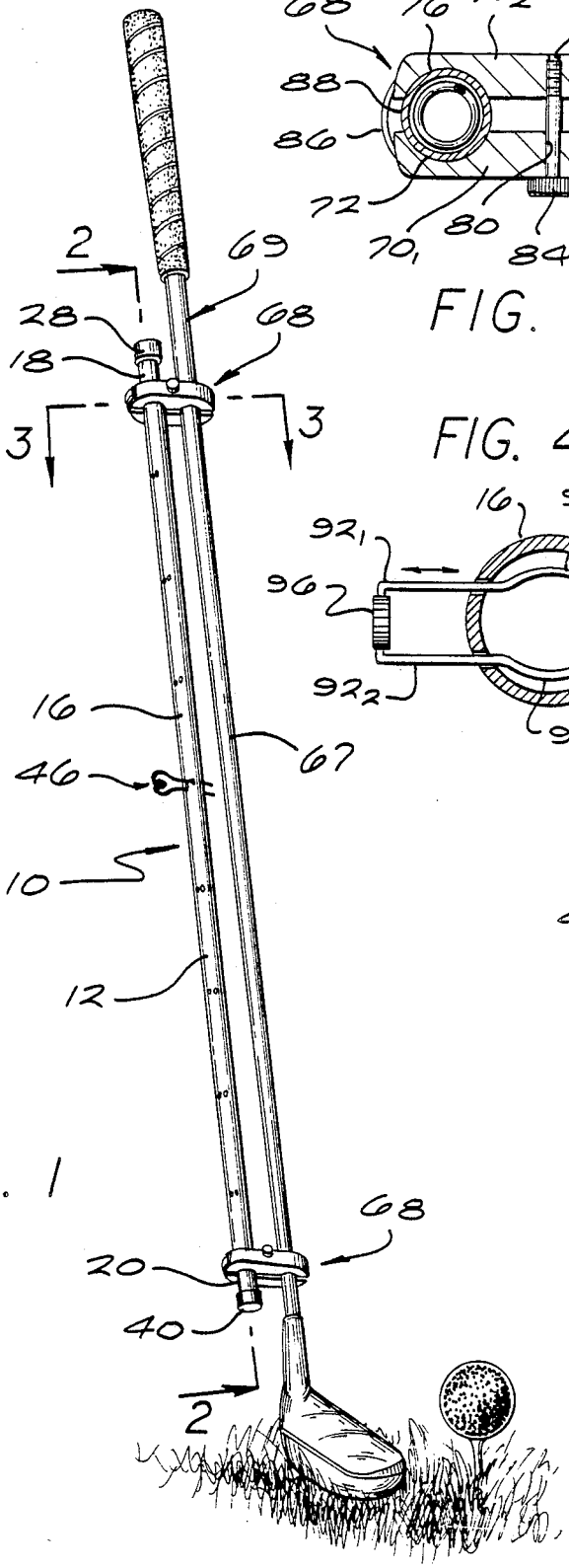
FIG. 1 illustrates a golf club swing training device constructed according to the principles of the present invention as used with a golf club.
Figure 2:
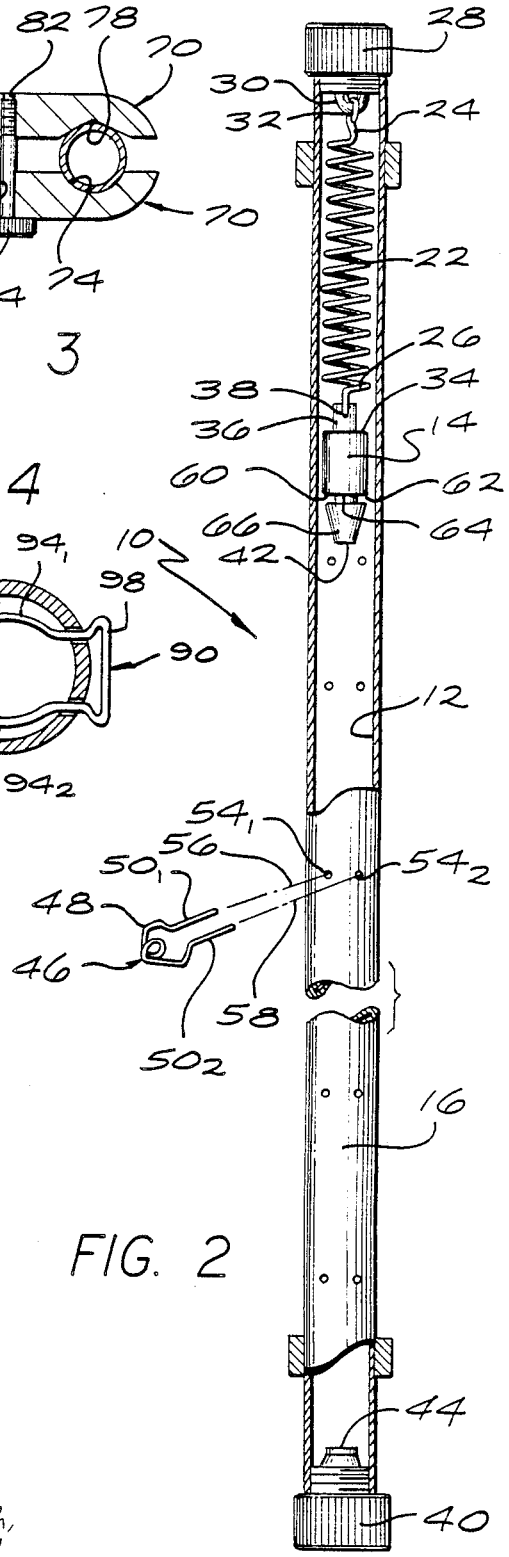
FIG. 2 is a broken view, partially in cross-section, of the golf club swing training device as taken along line 2—2 of FIG. 1.

Referring now to FIGS. 1–2, a golf club swing training device 10 includes an elongated track 12 and a weight 14 held by the track 12 in linear slidable engagement. In a preferred embodiment of the present invention, the track 12 may be an elongated hollow tube 16 having a first end 18 and a second end 20. The weight 14 is then received within the tube, as best seen in FIG. 2, in axially slidable engagement. Although the track 12 is described in conjunction with the tube 16, it should be apparent to those skilled in the art that any type of track could be used. For example, the track 12 could be a rod with a cylindrical weight coaxially disposed on the rod.

A spring 22 is disposed to bias the weight at the first end 18 of the tube 16 or track 12. In one embodiment of the present invention, the spring 22 is a coil spring coaxially disposed within the tube 16 at the first end 18. The spring 22 has a first end 24 attached within the first end 18 of the tube and a second end 26. The second end 26 of the spring 22 is attached to the weight 14.

More particularly, the golf club swing training device 10 may further include a first end cap 28 threadingly received by the first end 18 of the tube 16. The first end cap 28 has an eyelet 30 projecting into the tube. The first end 24 of the spring 22 has a hook 32 which is attached to the eyelet 30. Similarly, the weight has a first end 34 facing the first end 18 of the tube 16. The first end 34 of the weight 14 has an eyelet 36. The second end 26 of the spring 22 has a hook 38 attachable to the eyelet 36 of the weight 14.

The training device 10 further includes a second end cap 40 threadingly received by the second end 20 of the tube 16. The weight 14 further has a second end 42 facing the second end 20 of the tube 14. The second end cap 40 has a strike plate 44 disposed within the second end 20 of the tube 16 in a facing relationship to the second end 42 of the weight 14. During use of the training device, as the centrifugal force urges the weight toward the second end 20 of the tube 14, an audible click is heard as the weight 14 hits the strike plate 44.

In an alternative use of the above described golf club swing training device 10, the weight 14 is fixed at a selected axial position within the tube 16. To fix the weight 14, the training device 10 further includes a retainer pin 46 having a generally C-shaped portion 48, and a pair of parallel tines 50 extending from the C-shaped portion 48. The tube 16 further has at least one set of openings 54. A first pair $54_1$ of said openings 54 are disposed along a first secant 56 of the tube 16 at a selected axial position, and a second pair $54_2$ of the openings 54 are disposed at the same axial position along a second secant 58 of the tube 16. The second secant 58 is parallel to the first secant 56. A first one $50_1$ of the tines 50 is received along the first secant 56 through the pair $54_1$ of the openings 54. A second one $50_2$ of the tines 50 is received along the second secant 58 through the second pair $54_2$ of the openings 54. The Weight 14 further has a first notch portion 60 to receive the first tine $50_1$ and a second notch portion 62 to receive the second tine $50_2$. The retainer pin 46 then prevents the weight 14 from axial movement.

More particularly, the weight 14 is generally cylindrical and may have an annular notch 64 therein to form the first notch portion 60 and the second notch portion 62. The weight further has a frustoconical section 66 adjacent the annular notch 64 and narrowing toward the second end 42 of the weight 14. With the pin 46 disposed within the openings 54, the training device 10 may then be swung, urging the weight 14 toward the second end 20 of the tube 16. The frustoconical section 66 then slides past the tines 50, spreading the tines slightly until they become engaged within the annular notch 64. Removing the retainer pin 46 allows for the subsequent free movement of the weight.

Figure 4:
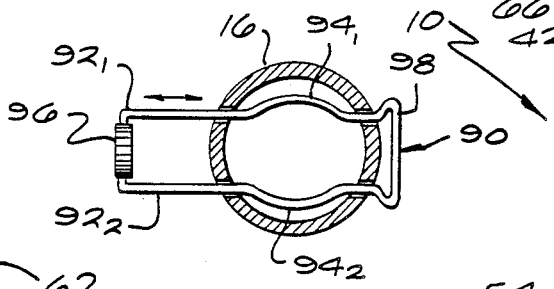
FIG. 4 is a cross-section view showing an alternative embodiment of the retainer pin.

Referring now to FIG. 4, an alterative embodiment of the retainer of the retainer pin 90 is shown. The alternative retainer pin 90 has an end grip 98, a pair of tines having a pair of semi-circular portions 94 and a pair of parallel portions 92, and a retainer pin coupler joining the two ends of the retainer pin 90. The alternative retainer pin 90 would be permanently inserted into one of the sets of openings 54 in tube 16.

The alternative retainer pin 90 is slideably movable between a first and second position. In the first position, as shown in FIG. 4, the two semi-circular portions 94 are concentrically positioned within the tube 16. With alternative retainer pin 90 in the first position, weight 14 is free to traverse the length of the tube 16 in normal use of the training device 10, unimpeded by retainer pin 90.

With the alternative retainer pin 90 moved to the second position, the parallel portions 92 are positioned to block passage of the weight 14. The swinging of the training device 10 urges the wright 14 toward the second end 20 of the tube 16, and the weight 14 becomes engaged by the parallel portions 92. As previously described, the weight 14 has a first notch portion 60 to receive the first parallel portion $92_1$, and a second notch portion 62 to receive the second parallel portion $92_2$. Once engaged by the parallel portions 92, weight 14 will remain captive by the alternative retainer pin 90. Sliding the alternative retainer pin 90 back to the first position will release the weight 14 to allow its subsequent free movement.

To attach the golf club training device 10 to the shaft 67 of a golf club 69, a pair of clamps 68 are provided. Each of the clamps 68 are adapted to mount a respective one of the first end 18 and the second end 20 to the shaft 67 of the golf club 69.

Figure 3:
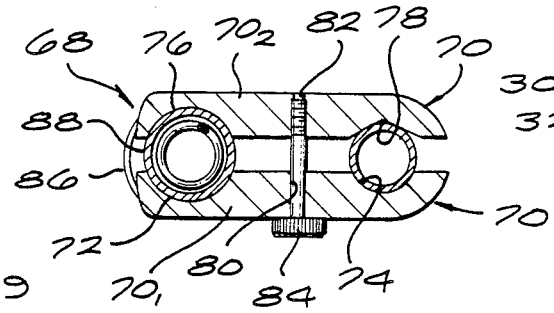
FIG. 3 is a cross-section taken along line 3—3 of FIG. 1.

As best seen in FIG. 3, each of the clamps 68 includes a pair of opposing members 70. A first one $70_1$ of the members 70 has a semicircular first channel 72 and a semicircular second channel 74 parallel to the first channel 72. A second one $70_2$ of the members 70 has a semicircular first channel 76 and a V-groove second channel 78 parallel to the first channel 76 of the second member $70_2$. The first semicircular channel 72 of the first member $70_1$ and the first channel 76 of the second member $70_2$ are in opposition to each other in dimension to receive the tube 16. The second channel 74 of the first member $70_1$ and the second channel 78 of the second member $70_2$ are in opposition to each other in dimension to receive the shaft of the golf club. The V-groove channel 78 is provided to accommodate different size golf club shafts.

The first member $70_1$ has a bore 80 disposed therethrough intermediate the first channel 72 and the second channel 74. The second member $70_2$ has a threaded bore 82 in opposition to the bore 80 of the first member $70_1$. A threaded fastener 84 is received through the bore 80 of the first member $70_1$ to engage threadingly the threaded bore 82 to secure the first member $70_1$ to the second member $70_2$, thereby clamping the training device 10 onto the shaft of a golf club.

Each clamp 68 may further include an elastic strap 86 attaching the first member $70_1$ to the second member $70_2$. Furthermore, each of the above described channels, 72, 74, 76, 78, may have an elastomeric surface 88, such as rubber, to prevent damage to the training device 10 and the golf club shaft.

There has been described hereinabove a novel golf club swing training device. It is readily apparent to those skilled in the art that numerous uses of and departures from the present invention may be made without departing from the inventive concepts disclosed herein. Accordingly, the present invention is to be defined solely by the scope of the following claims.

I claim:

1. A golf club swing training device comprising:

an elongated hollow tube having a first end and a second end;

a weight received within said tube in axially slidable engagement;

a spring disposed within said tube for pulling said weight toward said first end of said tube upon movement of said weight toward said second end; and a pair of clamps, each of said clamps being adapted to mount a respective one of said first end and said second end to a shaft of a golf club.

2. A training device as set forth in claim 1 wherein said spring is a coil spring coaxially disposed within said tube and has a first end attached at said first end of said tube and a second end attached to said weight.

3. A training device as set forth in claim 2 wherein said device further comprises:

an end cap threadingly received by said first end of said tube, said end cap having an eyelet projecting into said tube;

said first end of said coaxial spring having a hook attached to said eyelet.

4. A training device as set forth in claim 2 wherein said weight is generally cylindrical and has a first end facing said first end of said tube, said first end of said weight having an eyelet;

said second end of said coaxial spring having a hook attachable to said eyelet.

5. A training device as set forth in claim 4 further comprising:

an end cap threadingly received by said second end of said tube.

6. A training device as set forth in claim 5 wherein said weight further has a second end facing said second end of said tube and said second end cap has a strike plate disposed within said second end of said tube in a facing relationship to said second end of said weight.

7. A training device as set forth in claim 1 further comprising:

a retainer pin having a generally C-shaped portion and a pair of parallel tines extending from said C-shaped portion;

said tube further having at least one set of openings, a first pair of said openings being disposed along a first secant of said tube at a selected axial position and a second pair of said openings being disposed at said selected axial position along a second secant of said tube parallel to said first secant, a first one of said tines being receivable along said first secant through said first pair of openings and a second one of said tines being receivable along said second secant through said second pair of openings;

said weight further having a first notch portion to receive said first tine and a second notch portion to receive said second tine whereby said retainer pin fixes said weight from axial movement.

8. A training device as set forth in claim 7 wherein said weight is generally cylindrical and has an annular notch therein to form said first notch portion and said second notch portion.

9. A training device as set forth in claim 8 wherein said weight has a frustoconical section adjacent said annular notch narrowing toward said second end of said tube.

10. A training device as set forth in claim 9 wherein:

said retainer pin is slidably movable between a first and a second position, and said tines further comprise a pair of semi-circular portions and a pair of parallel portions; wherein at said first position, said semi-circular portions are concentrically positioned within said tube, enabling unimpeded traverse of said weight within said tube; and at said second position, said parallel portions are positioned partially blocking said tube enabling capture of said weight, and returning said retainer pin to said first position releases said weight from capture.

11. A training device as set forth in claim 1 wherein each of said clamps includes:

a pair of opposing members, a first one of said members having a semicircular first channel and a semicircular second channel parallel to said first channel, said semicircular first channel being dimensioned to receive said tube, said semicircular second channel being dimensioned to receive said shaft, a second one of said members having a semicircular first channel being dimensioned to receive said tube, and a V-groove second channel parallel to said first channel of said second member, said first channel and said second channel of said first member being in opposition to said first channel and said second channel of said second member, said first member having a bore disposed therethrough intermediate said first channel and said second channel thereof, said second member having a threaded bore in opposition to said bore of said first member; and a threaded fastener received through said bore of said first member to engage threadingly said threaded bore to secure said first member to said second member.

12. A training device as set forth in claim 11 wherein each channel has an elastomeric surface.

13. A training device as set forth in claim 11 further including an elastic strap attaching said first member to said second member.

* * * * *